United States Patent [19]

Anderka

[11] 3,963,359

[45] June 15, 1976

[54] PROTECTIVE SCREW CAP FOR THE WRITING POINT OF A TUBE WRITING PEN

[75] Inventor: Gerold Anderka, Ellerbek, Germany

[73] Assignee: Koh-I-Noor Rapidograph, Inc., Bloomsbury, N.J.

[22] Filed: Sept. 30, 1975

[21] Appl. No.: 618,179

[30] Foreign Application Priority Data

Feb. 25, 1975 Germany ..... 7505779[U]

[52] U.S. Cl. ..... 401/258

[51] Int. Cl.[2] ..... B43K 9/00; B43K 1/00

[58] Field of Search.... 401/194, 202, 214, 243–247, 401/269

[56] References Cited

UNITED STATES PATENTS

| | | | |
|---|---|---|---|
| 962,053 | 6/1910 | Rottenburg | 401/247 |
| 3,475,103 | 10/1969 | Danjczek | 401/194 |
| 3,802,788 | 4/1974 | Danjczek | 401/194 |

FOREIGN PATENTS OR APPLICATIONS

| | | | |
|---|---|---|---|
| 1,175,893 | 1/1970 | United Kingdom | 401/259 |
| 517,388 | 1/1940 | United Kingdom | 401/246 |
| 1,051,115 | 12/1966 | United Kingdom | 401/245 |

*Primary Examiner*—Lawrence Charles
*Attorney, Agent, or Firm*—David H. Semmes

[57] ABSTRACT

A receptacle or protective cap for the writing point of a tube writing pen, the pen comprising a writing cone provided with a writing tube and fitted into a sleeve, there being an ink equalization chamber in a space between the cone and the sleeve, wherein the cap comprises an open-ended hollow body adapted to be secured over the sleeve by its open end, the other end being closed, and wherein the cap has an improved inner annular sealing face for engaging against the end of the sleeve when the cap is secured over the sleeve, the sealing face being formed by a layer of soft resilient material attached to an annular rigid base.

8 Claims, 2 Drawing Figures

PROTECTIVE SCREW CAP FOR THE WRITING POINT OF A TUBE WRITING PEN

BACKGROUND OF THE INVENTION

This invention relates to a receptacle or protective cap for the writing point of a tube writing pen.

Receptacles or protective caps for the writing points of tube writing pens have been proposed and in one such protective cap there is provided a substantially cup-shaped sealing insert made of a resilient material such as polyethylene or polypropylene, having a cylindrical upper end forming an edge which, when the writing point has been firmly screwed or fitted into the cap, makes contact with the front edge of a sleeve of the pen which embraces the writing cone.

It transpires that geometrical stability requires the sealing insert to be made of a material that is only slightly resilient, so that the position of the upper edge of the sealing insert, i.e. its sealing face, will not in practice adapt the position of its surface inside the cap to ensure contact with the front edge of the sleeve. The relatively slight elastic resilience quite generally prevents the creation of a good seal between the upper edge of the sealing element and the front edge of the sleeve, or at least no seal is formed after the sealing face has been only once slightly deformed.

In theory this difficulty could be overcome by making the sealing element of a substantially softer and more resilient material. However, in the conventional type of sealing insert this would cause the sealing element to be axially deformed when the cap is screwed over the writing point of the tube writing pen. As such this deformation should not matter, but in practice it appears that axial deformation is accompanied by a deformation of the annular sealing face of the element so that, notwithstanding its soft resilience, a satisfactory seal is still not created between the sealing face and the front edge of the sleeve.

SUMMARY OF THE INVENTION

According to the present invention there is provided a receptacle or protective cap for the writing point of a tube writing pen, the pen comprising a writing cone provided with a writing tube and fitted into a sleeve, there being an ink equalization chamber in a space between the cone and the sleeve, wherein the cap comprises an open-ended hollow body adapted to be secured over the sleeve by its open end, the other end being closed, and wherein the cap has an inner annular sealing face for engaging against the end of the sleeve when the cap is secured over the sleeve, the sealing face being formed by a layer of soft resilient material attached to an annular rigid base.

Preferably the soft resilient material has a Shore hardness not exceeding A 80 and more preferably it should be less than A 60.

With the present receptacle, the layer of soft resilient material forms a sealing face which is deformed by the axial thrust of the front edge of the sleeve of the writing point of the tube writing pen when the writing point is screwed or fitted into place, so that a fully tight annular seal is created between the front edge of the sleeve and the annular sealing face. It is important to note that although the layer itself consists of a soft resilient material, the fact that this material is mounted on a rigid annular base in practice prevents it from being pushed out of position. Under axial compression the annular seal will be kept in place by the rigid base. Consequently the sealing effect will not be impaired even after a long term of service.

In a preferred embodiment of the invention the layer is formed on its underside with at least one projection which engages a corresponding recess in the rigid base, the projection as well as the recess preferably being annular. The engagement of the projection with the recess affords additional location for the layer on its rigid base and there is no likelihood of the layer moving during use or of detaching itself from its base.

Alternatively, in order to achieve an additional sealing effect, the layer may be provided with a cup-shaped extension projecting axially within the rigid base into the interior of the receptacle so that the wall of the bottom of the cup-shaped extension makes contact with the front face of the writing tube when the writing point has been inserted and the cap is secured over the sleeve. Contact at this point also seals the end of the writing tube and, if at the same time the part of the interior surface of the cup-shaped extension adjoining the inside edge of the layer makes sealing contact with a cylindrical part of the writing cone projecting from the sleeve, then this will simultaneously seal the ink equalization chamber of the writing point, which is located between the writing cone and the sleeve, from the air contained in the cup-shaped extension, thereby further reducing the risk of the ink in the equalization chamber drying out.

In order to enable the invention to be more readily understood, reference will now be made to the accompanying drawings, which illustrate diagrammatically and by way of example two embodiments thereof and in which:

DESCRIPTION OF THE PREFERRED EMBODIMENT

Figure 1:
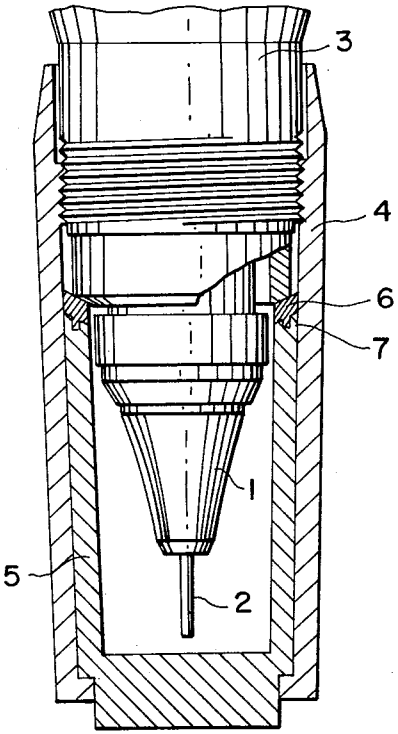
FIG. 1 is a section of a receptacle or protective cap adapted to be screwed over the writing point of a tube writing pen.

Referring now to FIG. 1, there is shown a receptacle or protective cap screwed over the writing point of a tube writing pen. The tube writing pen has a writing point comprising cone 1 which at its forward end is provided with a writing tube 2, the cone 1 being fitted into a sleeve 3. In conventional manner, an ink equalization chamber is provided in the space between the writing cone 1 and the sleeve 3.

The cap comprises a body 4 into which a cup member 5 is detachably though tightly inserted. At the upper end of this cup member 5, and some distance away from the screw threads by which the body 4 can be screwed into the sleeve 3, is an annular layer 6 of soft resilient material formed on its underside with a projecting annular fin 7 which fits into a corresponding shaped slot in the annular end face of the rigid base or cup 5. This joint, possibly assisted by an adhesive bond, secures the layer 6 to the cup 5. Naturally the layer is so located in relation to the screw threads that the forward edge of the sleeve 3 bears firmly in axial compression against this layer 6 and thus forms a seal when the cap has been screwed home over the writing point of the tube writing pen.

In order to provide a particularly reliable seal, the material of the layer 6 consists of a soft elastically resilient material, such as silicone rubber. The hardness of the layer 6 should not exceed 80 Shore A and preferably does not exceed 60 Shore A.

As illustrated in FIG. 1, the cap provides a secure covering and seal from the ambient air for the portion of the writing cone 1 projecting from the sleeve 3, i.e. for the writing tube 2 and the ink equalization chamber.

Figure 2:
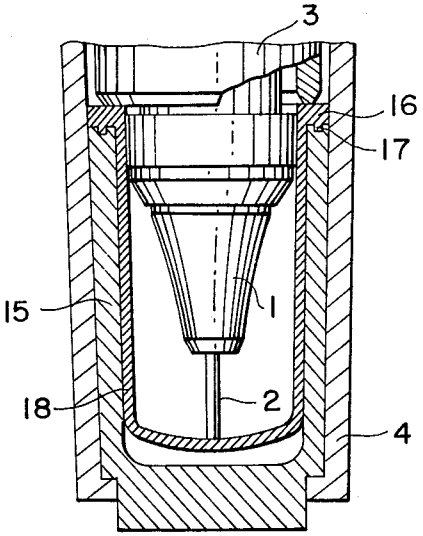
FIG. 2 is a section of another embodiment of a receptacle or protective cap.

In order additionally to provide a separate seal for the writing tube a cap such as shown in FIG. 2 may be used. This cap differs from that shown in FIG. 1 in that a layer 16 of soft resilient material which on its underside has an annular projecting fin 17 engaging a cup 15 is itself formed with a cup-shaped extension which proceeds from its inside edge, in such manner that the front end of the writing tube 2 makes contact with the bottom of the cup-shaped extension 18 when the cup has been screwed on the sleeve or firmly fitted, whereas the front edge of the sleeve 3 makes an annular compressive sealing contact with the layer 16 from above. Contact between the writing tube 2 and the bottom of the cup-shaped extension creates an additional seal for the end of the writing tube.

Furthermore, the upper end of the cup-shaped extension may be dimensionally so designed that it makes sealing contact with the cylindrical part of the writing cone projecting from the sleeve, as illustrated in FIG. 2. This third sealing contact in conjunction with the first sealing contact between the front edge of the sleeve 3 and the layer 16 ensures that the ink equalization chamber communicates with only a very small air volume because it is thereby also cut off from the air present in the cup-shaped extension 18. This provides an additional safeguard for preventing the ink inside the equalization chamber frm drying out.

I claim:

1. In a receptacle or protective cap for the writing point of a tube writing pen, the pen comprising a writing cone provided with a writing tube and fitted into a sleeve, there being an ink equalization chamber in the annular space between the cone and the sleeve, wherein the cap itself comprises of an open-ended hollow body adapted to be secured over the sleeve by its open end, the other end of said cap being closed, and wherein the improvement comprises a rigid base within said cap, and further comprising an inner annular sealing face for axially engaging against an annular projecting end of the sleeve when the cap is secured over the sleeve, said sealing face further comprising an annular layer of soft resilient material axially supported by an annular surface of said rigid base.

2. A receptacle according to claim 1, wherein the hardness of the soft resilient material does not exceed a Shore hardness of A 80.

3. A receptacle according to claim 1, wherein the hardness of the soft resilient material does not exceed a Shore hardness of A 60.

4. A receptacle according to claim 1, wherein said layer of soft resilient material is formed on its underside with at least one projection which operably engages corresponding recess in said annular support surface of said rigid base.

5. A receptacle according to claim 4, wherein the resilient projection and the engaging recess are annular.

6. A receptacle according to claim 1, wherein said resilient annular layer is further provided at its inside edge with a cup-shaped extension projecting axially within said rigid base to the interior of the receptacle, thereby defining a wall at the bottom of the cup-shaped extension operable for contact with the face of the writing tube when the cap is secured over the sleeve.

7. A receptacle according to claim 6, wherein part of said cupshaped extension adjoining the inside edge of said resilient annular layer further includes an interior surface operable for a sealing contact with a part of the writing cone projecting from said sleeve.

8. A receptacle according to claim 1, wherein said rigid base defining an inner annular sealing face comprises the upper end of a cup inserted into the receptacle.

* * * * *